US009562334B2

(12) United States Patent
von der Lippe et al.

(10) Patent No.: US 9,562,334 B2
(45) Date of Patent: Feb. 7, 2017

(54) METHOD FOR CONTROLLING A LOADING PROCESS OF A TRANSPORT VEHICLE WITH MILLED MATERIAL, DEVICE FOR IMPLEMENTING SUCH A METHOD AND A MILLING DEVICE

(71) Applicant: BOMAG GmbH, Boppard (DE)

(72) Inventors: Jörn von der Lippe, Koblenz (DE); Thomas Zahr, Pulheim (DE); Markus Lang, Pleizenhausen (DE); Rafael Schomaker, Lingen (DE); Filippo Baldassari, Spay (DE); Robert Laux, Neuwied (DE)

(73) Assignee: BOMAG GmbH, Boppard (DE)

( * ) Notice: Subject to any disclaimer, the term of this patent is extended or adjusted under 35 U.S.C. 154(b) by 783 days.

(21) Appl. No.: 13/624,586

(22) Filed: Sep. 21, 2012

(65) Prior Publication Data

US 2013/0080000 A1 Mar. 28, 2013

(30) Foreign Application Priority Data

Sep. 22, 2011 (DE) ..... 10 2011 114 183

(51) Int. Cl.
*G06F 7/70* (2006.01)
*G06F 19/00* (2011.01)
(Continued)

(52) U.S. Cl.
CPC ..... *E01C 23/088* (2013.01)

(58) Field of Classification Search
CPC ..... E01C 23/088; E02F 9/00; E02F 9/26; E02F 9/264
(Continued)

(56) References Cited

U.S. PATENT DOCUMENTS 5,575,316 A 11/1996 Pollklas
2010/0014917 A1* 1/2010 Willis et al. ..... 404/93
(Continued)

FOREIGN PATENT DOCUMENTS

DE 44 03 893 A1 8/1995
DE 10 2004 011 789 A1 9/2005
(Continued)

OTHER PUBLICATIONS

Espacenet.com, English Machine Translation of German Patent No. DE4403893A1, published Aug. 10, 1995, retrieved from http://worldwide.espacenet.com on Sep. 24, 2012 (13 pages).
(Continued)

*Primary Examiner* — Calvin Cheung
*Assistant Examiner* — Paula L Schneider
(74) *Attorney, Agent, or Firm* — Wood Herron & Evans LLP

(57) ABSTRACT

The present invention relates to a method for controlling a loading process of a transport vehicle by a milling device in milling operation, a device for implementing this method and a road milling machine or a device for the removal of soil material with such a device. One aspect of the present invention, according to one embodiment, is a sensor device by means of which the position and partially also the fill level of the transport container of the transport vehicle can be determined.

21 Claims, 7 Drawing Sheets

(51) Int. Cl.
*G06G 7/00* (2006.01)
*G06G 7/76* (2006.01)
*E01C 23/088* (2006.01)

(58) Field of Classification Search
USPC ..... 701/50
See application file for complete search history.

(56) References Cited

U.S. PATENT DOCUMENTS

| | | | | |
|---|---|---|---|---|
| 2011/0061762 | A1* | 3/2011 | Madsen et al. | 141/1 |
| 2011/0080034 | A1* | 4/2011 | Schonebeck et al. | 299/1.5 |
| 2011/0123268 | A1† | 5/2011 | Berning | |
| 2011/0307149 | A1* | 12/2011 | Pighi | A01D 41/127 701/50 |

FOREIGN PATENT DOCUMENTS

| | | | |
|---|---|---|---|
| DE | 10 2005 035 480 | A1 | 2/2007 |
| EP | 1 574 122 | A1 | 9/2005 |
| WO | 2009098294 | A2 † | 8/2009 |

OTHER PUBLICATIONS

Espacenet.com, English Machine Translation of German Patent No. DE102004011789A1, published Sep. 29, 2005, retrieved from http://worldwide.espacenet.com on Sep. 24, 2012 (11 pages).

Espacenet.com, English Machine Translation of German Patent No. DE102005035480A1, published Feb. 1, 2007, retrieved from http://worldwide.espacenet.com on Sep. 24, 2012 (9 pages).

German Patent Office, Search Report of German Application No. DE102011114183.2, dated Jun. 27, 2012 (4 pages).

Espacenet.com, English Machine Translation of European Patent No. EP1574122A1, published Sep. 14, 2005, retrieved from http://worldwide.espacenet.com on Sep. 10, 2015 (10 pages).

* cited by examiner
† cited by third party

METHOD FOR CONTROLLING A LOADING PROCESS OF A TRANSPORT VEHICLE WITH MILLED MATERIAL, DEVICE FOR IMPLEMENTING SUCH A METHOD AND A MILLING DEVICE

CROSS-REFERENCE TO RELATED APPLICATIONS

The present application claims priority under 35 U.S.C. §119 of German Patent Application No. 10 2011 114 183.2, filed Sep. 22, 2011, the disclosure of which is hereby incorporated herein by reference in its entirety.

FIELD OF THE INVENTION

The present invention relates to a method for controlling a loading process of a transport vehicle with milled material, a device for implementing such a method and a milling device, in particular a road milling machine, with such a device.

BACKGROUND OF THE INVENTION

From the prior art, milling devices are known which comprise a machine-frame-supported milling rotor that is arranged transverse to the working direction. In milling operation, such milling devices traverse overground, with the milling rotor submerging in the ground and milling off the soil material with the help of the milling tools arranged on the rotating milling rotor. In milling operation, the milling device thus moves in the working direction and traverses over the soil to be processed. Typical areas of application of such milling devices include road and pathway construction, for example, in the form of road milling, and the removal of soil material, e.g. in open-cast mining operation. Such milling devices are also preferably designed as self-propelled machines, thus eliminating the need for separate towing vehicles.

An important aspect in the operation of such milling devices is the handling of the milled material, i.e. the material milled by the milling rotor. In many areas of application, it is necessary that the milled material is transported away from the milling location by means of a suitable transport device, for example, a truck. To this end, the milling device usually has a conveyor by means of which the milled material can be transported during the milling operation of the milling device from the area of the milling rotor to the transport container of the transport vehicle. Here, various embodiments are known in regard to the specific arrangement of the conveyor device in relation to the transport vehicle. Apart from the possibility that the conveyor transports the milled material—relative to the working direction of the milling device—to the rear ("rear-loader") or to the side ("side-loader"), a conveyor belt directed to the front ("front-loader") has particularly proven suitable for milling devices designed as road milling machines. The latter has the advantage that during milling operation the transport vehicle may drive in front of the milling device on the ground still to be milled. However, especially this loading type normally places stricter requirements on the milling machine operator. For example, in particular the visibility of the preceding transport trucks is poor and the milling machine operator cannot see the loading trough completely, for instance. The driver of the transport truck cannot see the loading conveyor either. This is especially true when the visibility is also impaired by the local conditions, as is often the case in road construction, for example, due to road curves, narrow roads, traffic flow in the surroundings, ground obstacles, such as manhole covers, etc. In addition, the milling machine operator bears the responsibility for safe work process, particularly with regard to road safety and personal safety. Further, for proper removal of the milled material, precise control of the loading process is desirable. On the one hand, the milled material, which is often milled pavement, has a relatively high density, which can quickly lead to overloading. On the other hand, the transport trucks commonly used here move at speeds of up to 100 km/h, so that the overloaded vehicles may pose a particularly high safety risk.

The fact that the milling device in the working or milling mode is usually in driving operation, that is, it moves along in the working direction, the transport vehicle cannot remain at one place over the entire loading process. It must rather move with the milling device along the working direction in order to remain within the loading range of the conveyor. Since the milling device in milling operation often moves relatively slow, repeated starting and stopping of the transport vehicle has established, which at the same time particularly also allows for uniform loading of the transport container of the transport vehicle. This process will be explained in further detail below, by examples of the operation of a front-loader road milling machine.

In milling operation, for this purpose, a transport vehicle with a transport container travels ahead of the milling device and receives the milled material via the conveyor. The coordination of the moving milling device and the moving transport vehicle is of particular importance here. On the one hand it has to be ensured that the milled material can be dropped from the conveyor into the transport container of the transport vehicle. On the other hand, it is necessary to prevent a collision of the two vehicles during milling and loading operation. Presently, the responsibility for coordination of the relative position of the transport vehicle to the milling device is essentially borne by the operator of the milling device. This operator continuously monitors the distance of the milling vehicle to the transport vehicle and alerts the driver of the transport vehicle continuously by issuing the commands "move forward", "stop", and "depart" for adjusting the position of the transport vehicle relative to the milling device moving in milling operation along the working direction. This usually happens via an alarm signal. Specifically, the milling device moving at essentially constant working speed approaches the transport vehicle up to a minimum distance. The machine operator then issues the "move forward" command, until the transport vehicle has driven forward to the maximum distance for the loading operation and causes the transport vehicle to stop with the command "stop". The maximum distance is the distance between the transport vehicle and the milling device still just allowing the conveyor to discharge the milled material to the rear area of the transport container, without significant amounts of the milled material falling to the ground behind the transport container. The minimum distance is accordingly the distance at which the conveyor is still just able to discharge the milled material to the front area of the transport container or at which the milling device does not collide with the transport vehicle yet, whichever distance is greater. Once the transport container of the transport vehicle has reached its specified fill, which is also monitored by the milling machine operator, the operator indicates completion of the loading process with the "depart" command. Then the loaded transport vehicle departs. This type of loading operation places enormous demands on the operator of the milling device, who, in addition to the milling process (especially observation of the milling edge, operation and control of the machine during the milling process as well as location of the surroundings of the machine), also has to observe the loading process or the relative position between the transport vehicle and the milling device. This leads to considerable stress to the machine operator.

SUMMARY OF THE INVENTION

The object of the present invention is to provide an option to relieve the machine operator during the working operation of the milling device and simultaneous loading of the transport vehicle.

The basic idea of the present invention is that the embodiments of the present invention relieve the machine operator of the need for continuous monitoring of the relative position of the transport container of a transport vehicle in relation to the milling device, and this process runs at least largely automatically according to the present invention. Accordingly, it is not necessary any longer for the machine operator to continually ensure that the transport vehicle during milling operation of the milling device is always in a position suitable for loading, and is thus able to concentrate on the implementation of the actual milling work.

One aspect of the present invention lies in a method for controlling a loading process of a transport container of a transport vehicle which is loaded during milling operation by means of a milling device, the milling device comprising a conveyor by means of which the milled material is transported to the transport container during milling operation of the milling device. The method according to one embodiment of the present invention comprises the steps a) detecting the relative position of the transport container in the loading range of the milling device with the help of a sensor device, b) starting the loading process by starting up the conveyor, c) monitoring the relative position of the transport container by means of the sensor device, and preferably also controlling the loading process depending on the relative position of the transport container, and d) outputting a signal to the machine operator of the milling device, when a desired fill of the transport container is detected, or when the sensor device detects a removal of the transport container from the loading range. The signal according to step d) may be issued, for example, by means of an optical and/or acoustic signal, and/or also comprise automatic stoppage of the loading process. Thus, the method according to one embodiment of the present invention is essentially characterised by the monitoring of the transport container using a sensor device which is designed for the detection and tracking of the position of the transport container, and preferably also for monitoring the fill level or for monitoring the attainment of a desired fill during the loading process. This provides for automatic monitoring of the loading process, so that the operator no longer needs to observe the position of the milling device relative to the transport container at all times and, depending on the embodiment, also need not provide appropriate control commands to the driver of the transport vehicle. The operator can focus on the milling work instead. Simultaneously, for example, a high accuracy of central loading of the transport container is made possible, so that the milled material in the transport container can be distributed to the edge regions by gravity and flow behaviour.

With the first step, the detection of the relative position of the transport container in the loading range of the milling device with the help of a sensor device, it is determined according to the method whether a transport container is present in the loading range of the milling device. The loading range of the milling device is the area in which the conveyor can transfer or discharge the milled material received during the milling process. For example, in case of a conveyor belt arranged on the milling device as a conveyor device, the loading range is in other words the discharge area of the conveyor. The loading range is displaced accordingly as a function of the height and other factors, such as the rotational speed of the transport belt of the conveyor belt. Thus, the milled material is discharged into the transport container only if the loading range is located above the transport container of the transport vehicle. The relative position according to the method refers to the position of the transport container in relation to the milling device and especially in relation to the conveyor device of the milling device. The sensor device is now designed according to the present invention such that it can detect the presence of at least a portion of the transport container in the loading range for receiving milled material. Specific embodiments of the sensor device will be described in greater detail below. In principle, for example, a two-dimensional test may be performed to find whether the loading range overlaps with at least a part of the transport container in the horizontal plane. Alternatively, three-dimensional information, such as the distance of the transport loading range to the transport container in the vertical direction, may also be considered.

After the sensor device has detected the presence of at least a partial area of the transport container in the loading range or it is ensured that the milled material discharged from the transport device lands in the transport container, the loading process is commenced by starting up the conveyor. This can, for example, occur automatically. Alternatively, for example, a start or enable circuit may be released, which allows a manual start of the loading process by the machine operator. According to one embodiment of the present invention, starting up the conveyor includes also the signalling to the machine operator that the sensor device has detected that the loading range is positioned above the transport container. Coordination between the steps a) and b) is effected via a control unit which is functionally connected to the sensor device and optionally further devices, such as the enable circuit, the milling device. A functional connection is present, if the connection allows communication between the two elements, and in particular, data and/or control commands can be received and/or sent. Besides a mechanical connection, a functional connection also includes cable connections, for example, for transmission of electrical or optical signals, and wireless connections, such as radio communication connections.

During the loading process, the milling device advances above the ground to be milled off. This is accompanied by continuous monitoring of the relative position of the transport container to the milling device or to the loading range of the conveyor by means of the sensor device. Thus, the essential element of this step is that the sensor device continues to monitor the extent to which the loading range of the conveyor is at least over a portion of the transport container and the milled material is discharged accordingly into the transport container. Simultaneously, depending on the monitoring result (or, depending on the question whether the loading range is above the transport container), a signal is issued, for example, optically, acoustically and/or in the form of at least one control function when a predetermined fill level has been reached or the loading range no more overlaps completely with the transport container or with the receiving opening of the transport container. Thus, issuing a signal is to be understood broadly and includes all measures that are appropriate to indicate to the machine operator the situations "predetermined fill level attained" and/or "transport container removed from the loading range". By a control of an optical and/or acoustic signalling device, it is possible, for example, to notify the machine operator of the attainment of the predetermined fill level or of the removal of the transport container from the loading range. Alternatively or additionally, issuing a signal may also be a pure control function. Control functions for the loading process, for example, may generally include all the measures that, in some form or the other, affect the loading process, in particular, the commands "Conveyor ON" and "Conveyor Off", for instance. It goes without saying that various signals or control functions can be simultaneously activated. Overall, this brings considerable relief to the milling machine operator, in particular, because he or she no longer needs to constantly monitor and control the loading process of the milled material onto the transport vehicle.

The loading process is preferably stopped according to the method when a predetermined fill level of the transport container is detected, or when the sensor device detects a removal of the transport container from the loading range. The predetermined fill level is the fill level that cannot be exceeded to prevent overloading of the transport vehicle. The predetermined fill level can be defined as a function of the filling volume of the transport container and/or in particular, the filling weight of the transport container. Reaching the predetermined fill level can be determined in different ways. Ideally, this is also carried out with the help of the sensor device, although other methods, for example, weight-based methods, are possible. Removal of the transport container from the loading range can be given, for example, when the distance between the milling device and transport vehicle is too large. This can occur during milling operation, in particular, in milling devices loading to the rear or to the side, if the milling device in the milling operation is too far from the transport vehicle or accordingly, in front-loader milling devices, if the transport vehicle is driven up too far forward or not reset close enough to the milling device, so that the transport container is not in the loading of the transport device yet and thus the milled material cannot be discharged into the transport container yet.

The specific implementation of the position determination of the transport container by the sensor device can vary as well. For example, corresponding marking elements on the transport container may be provided which are detected selectively by the sensor device and used for drawing conclusions on the current position of the transport container. This may, for example, be suitable reflectors and/or transponder elements. The sensor device can also be designed, in particular, in such a way that it detects the top edge of the transport container or its peripheral edge, as it is known to be possible, for example, with known optoelectronic equipment. On the one hand this has the advantage that the container need not be designed in a specific way, as the use of transport containers with an open top and a peripheral edge is very common, and on the other hand, a large number of devices are known, by means of which such an "edge detection" can be made quickly.

Basically, it is also possible to design the sensor device in such a manner that it always covers the entire transport container, or at least the peripheral upper edge of the transport container and monitors its relative position. However, this is often not possible. This may be, for example, due to the specific arrangement of the sensor device and/or the dimensions of the transport container and/or the sensor range (area that can be detected by the sensor) of the sensor device. However, it has been observed that even the detection of sub-areas of the transport container by means of the sensor device is sufficient for implementing the method according to the present invention. For this case, it has proven to be advantageous if the following operations are performed when monitoring the relative position of the transport container by means of the sensor device: 1. Detection of at least a sub-area of the transport container, in particular a portion of the upper edge of the transport container, and determining the fill level in this sub-area of the transport container, 2. Storing the fill level detected in step 1 in the at least one sub-area, 3. Detection of another sub-area of the transport container, determining the fill level in this sub-area, and saving the detected fill level of this sub-area, 4. Determining the total filling with the help of the latest data currently determined in step 3 and stored in step 2, 5. Updating the fill levels of already detected sub-areas of the transport container and 6. Determining the degree of filling of the transport container on the basis of the latest fill levels of each of the sub-areas of the transport container. The basic concept in this embodiment is thus a virtual division of the transport container into a plurality of sub-areas, which are monitored separately by the sensor device. At the same time, the control unit creates a history of the already detected sub-areas and finally determines the total filling level of the transport container from the combination of currently determined sub-area and other stored sub-areas. due to the fact that the distance between the milling device and the transport vehicle varies between maximum proximity in the loading range and maximum distance in the loading range during milling operation, the sensor device with its detection range is repeatedly led over the entire transport container, in particular its upper edge. However, as the sensor device can scan and monitor only a portion of the transport container for attainment of the predetermined fill level, the sensor device cannot simultaneously determine the degree of filling of the transport container in its entirety. The method according to one embodiment of the present invention solves this problem by dividing the transport container into a plurality of sub-areas and using each of the fill levels determined for the sub-areas for the calculation of the total fill level of the transport container. In the process, it is always resorted to the most recent record, so that, for example, for the case that the first sub-area has been checked a total of three consecutive times by the sensor device, the last, and thus the currently determined fill level record forms the basis of the determination of the total fill level. These steps are specifically performed, for example, by a control unit which receives the data from the sensor device, stores them and updates them with respect to the respective sub-area.

Essential criteria for proper filling of the transport container with milled material are, on the one hand, the transport of the milled material into the transport container with the help of the conveyor with the least loss of milled material as possible and, at the same time, the maximum and/or most uniform possible loading of the transport container with milled material to facilitate efficient removal of the milled material from the work site. The strategy for filling of the transport container can be loading from the rear or the front or, preferably, uniformly over the transport container to protect the transport vehicle. In an advantageous embodiment, the present invention proposes in this context that, during the step c) (monitoring the relative position . . . ), and in particular during the control of the loading process (which is, for example, also during the step c)), detection of the discharge path of the milled material discharged from the conveyor into the transport container takes place together with the regulation of the lateral deflection of the discharge path relative to the transport container, through lateral adjustment of the conveyor and/or regulation of the discharge width of the discharge path, in particular by regulating the operating speed of the conveyor, through vertical adjustment of the conveyor and/or by an adjustment of the position angle of the conveyor. Working speed refers specifically to the rotational speed of the transport belt of a conveyor belt. Therefore, regardless of the relative movement of the milling device to the transport container, in this embodiment, the discharge point of the milled material in the transport container is varied in different ways by adjustment of the conveyor. Therefore, it is logically necessary at first that the discharge point in the transport container is known. To this end, the sensor device can detect the discharge path of the milled material, and at least determine one virtual discharge point, in particular at the level of the upper edge of the transport container. It is important that the milled material may not fall out from the transport container below this virtual discharge point, which is the case, for example, below the upper edge of a transport container. Subsequently, fine control of the discharge path or influence of the virtual point of discharge, in the plane of the upper edge of the transport container, may be carried out in various ways. Specifically, for example, a lateral deflection of the conveyor for lateral adjustment of the discharge path can be triggered, so that the discharge point of the milled material moves to the right or to the left relative to the working direction. Lateral deflection thus denotes a change in the discharge path to the right or left sides. Additionally or alternatively, for example, the discharge width of the discharge path may be adjusted, for example, by increasing or decreasing the rotational speed of a conveyor belt or height adjustment or position adjustment of the conveyor. On the whole, a particularly uniform distribution of the milled material in the entire transport container can be achieved in this way. It goes without saying that suitable actuators that are controlled by the control unit are available to trigger the individual control functions.

To further relieve the machine operator, besides the above-described monitoring by the sensor device as to whether there is a transport container in the loading range, further preferably, the distance between the transport vehicle and the milling device during milling operation is also automatically controlled or regulated as far as possible or is coordinated at least without an intervention by the machine operator. According to one aspect of the present invention, the control unit in this case is preferably designed in such a way that it controls, depending on the degree of loading of the transport container and/or the distance between the milling device and the transport vehicle, a signalling device that issues at least one signal for the instructions "drive forward", "stop" and "depart". The instructions are preferably issued in a way perceptible to the driver of the transport vehicle. Thus, with the help of the signalling device, the control unit is able to regulate the relative position between the transport vehicle and the milling device by the automatic issue of appropriate commands to the driver of the transport vehicle. Thus, the operator of the milling device, depending on the filling strategy, no longer has to make sure, for example, that the transport vehicle drives forward and stops in time during the loading process and thus moves in coordination with the milling device during milling operation. This embodiment of the method according to the present invention is characterised in that the driver of the transport vehicle automatically receives his/her operation commands from the signalling device controlled by the control unit during the loading process. Alternatively, it is also possible that the control unit directly controls the driving motion of the transport vehicle during the loading process, for example, via corresponding remote control devices or a mechanical coupling which is designed in such a way that it can also be controlled by the control unit for distance regulation. Preferably, this method can be applied to road milling devices which, relative to the working direction, load to the front and thus to a transport vehicle travelling ahead.

As already described above, the transport vehicle with its container moves back and forth between a maximum and a minimum spaced relative position to the milling device due to the repetitive moving forward and stopping during the loading process. In the case of milling devices loading to the front, or in working direction, the transport vehicle is, for example, initially spaced to the maximum. Maximum spacing means that the milled material is just still discharged into the rear area of the transport container. The maximum distance thus corresponds to a position of the loading range of the milling device at the rear end of the transport container. In milling operation, the milling device approaches the transport vehicle standing ahead in the working direction until a minimum distance is reached. The minimum distance is reached if there is imminent collision between the two vehicles or the milled material is just still dropped fully into the front area of the transport container and not to the front beyond the container. In the latter case, the loading range is at the front end of the transport container. Afterwards, the transport vehicle drives forward again until the maximum distance is restored. This process is repeated until the transport container of the transport vehicle is filled in the desired manner. In a preferred embodiment, the control unit selectively correlates this distance sequence "maximum distance-minimum distance-maximum distance- . . . " between the transport vehicle and the milling device with an alternating detection of the front and the rear upper edge of the transport container. Specifically, the front and rear upper edge of the transport container are used in this case by the control unit as a measure for the attainment of the maximum distance (the rear edge of the transport container) and the minimum distance (the front edge of the transport container). This embodiment is particularly advantageous as the sensor devices used in this context can usually detect the front and the rear top edge of the transport container particularly safely and reliably, for example, because it visually clearly stands out from its surroundings.

Ideally the control unit has access to as many operating parameters of the milling device as possible to control the loading process optimally. Preferably, the control unit considers at least one, and especially a plurality of the operating parameters, such as "traversing operation of the milling device," "traversing speed of the milling device during milling operation", "activation of a milling rotor", "milling depth of a milling rotor", "operating state of the conveyor," "conveying speed of a conveyor belt of the conveyor", "lateral deflection angle of the conveyor belt" or "angle of inclination of the conveyor belt." The traversing speed of the milling device in a milling operation is so far a very important variable, as it has a direct influence on the relative distance between the milling device moving along the working direction in milling operation and the transport vehicle. Activation of milling rotor is relevant insofar as the milled material is obtained only when the milling rotor is activated. The milling depth of the milling rotor provides information on how much milled material is obtained per unit of distance. The term "operating state" of the conveyor particularly refers to determining the fact whether the conveyor is in operation or not. The conveying speed of a conveyor belt of the conveyor refers to the rotational speed of the conveyor belt and thus correlates with the discharge width of the milled material or represents a control variable for varying the discharge width of the milled material. The lateral deflection angle of the conveyor belt refers to the deviation of the conveyor belt position along the horizontal direction from a line extending in the working direction of the milling device and the angle of inclination of the conveyor belt gives accordingly the angular position of the conveyor belt in a vertical plane extending along the conveying direction of the conveyor belt from the perpendicular standing on the ground. Both variables are suitable also for fine adjustment of the discharge point during the loading process, particularly the discharge width. For determination of the individual operating parameters, preferably suitable devices, such as sensors, which transmit the respective measurement data to the control unit, are provided. If certain parameters are regulated actively by the control unit, such as the inclination and/or lateral deflection angle of a conveyor belt, further suitable actuators are provided which can be controlled by the control unit.

The present invention also relates to a device for controlling a loading process of a transport container of a transport vehicle by means of a milling device in milling operation, ideally for implementing the above-described method, wherein the milling device comprises a conveyor by means of which the milled material is transported to the transport container during milling operation of the milling device. An essential element of the device according to one embodiment of the present invention is a sensor device that is designed for detecting the relative position of the transport container to the milling device, and a control unit which controls the loading process on the basis of the relative position of the transport container to the milling device detected by the sensor device. In other words, the device is able to determine the distance of the transport container to the milling device and in particular to the conveyor, in particular the discharge device, of the milling device and to transmit this information to the control unit. This device can be used accordingly to ensure that the transport container is within the range of the conveyor or its loading range during the loading process. The control unit can now be designed, according to a first aspect of the present invention, in such a manner that it interrupts the loading process of the conveyor automatically when the sensor device does not detect any transport container in the loading range or the transport container has left the loading range. This ensures that milled material is conveyed via the conveyor only if a transport container for receiving the milled material is present in the loading range and the milled material can be transferred to the transport container.

Providing for an efficient loading process does not require the sensor device to always cover the entire receiving area of the transport container. What is essential, according to one embodiment, is that the relevant filling opening for the transport container is detected or it is guaranteed that the milled material is as fully as possible discharged into the transport container. Typical transport containers, for example, appropriately equipped semitrailers, usually have a transport container with an open top and usually a circular upper edge. The upper edge represents the outer dimensions of the transport container in the vertical direction. Adequate position determination of the transport container relative to the milling device is thus already obtained with a sensor device which is designed to detect this upper edge of the transport container. Further, in certain embodiments, it is already sufficient if the sensor device is designed to detect only a sub-area of the top of the transport container. Thus, the sensor device may differentiate the upper edge portions and portions adjacent to the upper edge inside and outside of the transport container during practical use. What is crucial is that the sensor device detects whether the milled material can be and is transferred into the transport container or whether the loading range of the conveyor is within the outer dimensions of the transport container.

Basically, for the specific design of the sensor device, all sensor devices that are known from prior art and are suitable for the present application can be used. For this, the transport container could include suitable transponder elements, reflectors, etc., which can be used in conjunction with a suitable sensor device for position determination. However, the use of a sensor device with a sensor that is configured to detect spatial information or 3D information is preferred. Particularly suitable, for example, is a camera device with at least two mutually spaced imaging elements, such as a so-called stereo vision camera, in particular. However, in principle, alternative electro-optical devices are also possible, such as, in particular, a camera with a PMD sensor (Photonic Mixer Device). Electro-optical devices are generally characterised by their comparatively easy installation and high reliability in practical use. A stereo vision camera and a camera with a PMD sensor are particularly advantageous in that they are specially suitable for receiving three-dimensional information, which is advantageous, for example, with regard to a fill level determination of the transport container. PMD sensors also allow efficient suppression of extraneous light, so that the sensor device can be used in a wider range of applications.

The specific structural design and arrangement of the sensor device can also vary. Basically, it is possible to arrange the sensor device completely or at least partially on the side of the transport container. In this case, the sensor device determines the relative position of the milling device or the discharge device of the conveyor, based on the position of the transport vehicle. However, particularly preferably, the sensor device is arranged on the side of the milling device so that the individual transport vehicles need not be equipped with corresponding components of the sensor device. On the side of the milling device thus means being arranged on the milling device, or at least on an element moving with the milling device. Since the transport containers are usually loaded from above, it is particularly useful to arrange the sensor device in such a way that it can determine the dimensions of the transport container and also, ideally, its fill level. To this end, the sensor device is arranged at least partially in the vertical direction higher than the transport container and, in particular, higher than the upper edge of the transport container to be overcome by the conveyor. In detail, such an arrangement of the sensor device is particularly advantageous on the conveyor of the milling device, which preferably comprises a conveyor belt and a support frame. Conveyor belt and the supporting frame thus form a functional unit which is attached to the milling device often in an obliquely ascending manner and normally projects beyond the upper edge of the transport container. For this embodiment, it is particularly suitable if the sensor device is arranged on the support frame, especially at the upper end of the support frame. The support frame directly includes both the elements carrying the conveyor belt as well as e.g. linings, cross braces, etc. The upper end portion is the above third in the vertical direction with respect to the maximum longitudinal extension of the conveyor belt. The sensor device is ideally arranged as high as possible on the supporting frame in order to achieve the greatest possible viewing angle in the transport container. The sensor device is also preferably designed as a structurally separate module with its own housing, so as to be, for example, suitable for retrofitting. Basically, however, the sensor device can also be designed integrated into components of the milling device.

In addition to relieving the machine operator of the permanent checking of whether a transport container is located within the loading range, it is further advantageous if the device for controlling a loading process can at the same time influence the relative position of the transport vehicle relative to the milling device in a certain way. For this purpose, in a preferred embodiment, for example, a signalling device operated by the control unit may be provided which is designed to display at least the three control functions, "drive forward", "stop" and "depart". The signalling device has essentially the task of signalling the driver of the transport vehicle, independent of the operation of the milling device by the machine operator, whether the driver is expected to stop during loading or milling operation, or depart when the transport container has reached its predetermined fill level. The signalling device is preferably attached to the milling device, in particular to a portion of the milling device facing the transport vehicle. However, according to alternative embodiments, a mobile signalling device is also possible, which can be attached, for example, in the area of the driver of the transport vehicle for the loading process, or a more extensive system solution, which has, for example, permanently integrated signalling devices on the side of the transport vehicle and/or the side of the milling device, which automatically communicates, for example, via radio, with the control unit usually arranged on the milling device. For signalling, the signalling device may basically resort to all that is suitable for this purpose. Ideally, the signalling device comprises an optical and/or acoustic display element for displaying the at least three control functions. An optical display element can be, for example, a light panel, a screen or the like, by means of which, different command symbols can be optically displayed in a traffic light-like manner. The acoustic display element may be, for example, a horn, wherein, in a further preferred embodiment, the control unit resorts to a standard horn already existing in milling devices of the generic type. For each command, a certain series of horn signals, etc. can be provided.

As already mentioned above, cases occur in practical use in which the sensor device does not or cannot detect the complete transport container and in particular, the complete circumferential top edge of the transport container at each loading position of the transport vehicle relative to the milling device. The sensor device rather detects whether the loading range is at least in a part of the transport container. In this case, preferably, the sensor device also finds the direction in which the transport container runs (for example, forward or backward) and the direction in which it extends. This question is relevant for determining whether the loading range covers the front or the rear portion of the transport container. However, assessing the extent to which the transport container has reached its predetermined fill level depends on the total fill level of the transport container. In other words, the part of the transport container currently undetected by the sensor device is also to be considered here. According to one embodiment of the present invention, it may be provided that the control unit comprises a memory element, in particular in the form of a rolling memory, wherein the memory element is designed to store the data determined by the sensor device and stores the most recent record with respect to the respective sub-area of a transport container. With regard to the entire transport container, the control unit thus creates a history of the data detected by the sensor device on the individual sub-areas. As the milling device approaches the at first maximum spaced transport vehicle up to a minimum distance during the loading process, and the sensor device is arranged at least in the way that it can detect the transport container or the upper edge thereof in full during this approaching process, through the sensor device and the creation of a history, the total detection of the transport container or at least the full circumferential upper edge of the transport container is possible, and the total degree of filling of the transport container can be identified, even though the sensor device detects only a portion of the transport container at a time. A rolling memory, in which the most current data of the relevant sub-area of the transport container is stored and the older data are discarded accordingly is advantageous in that it only requires a relatively low storage capacity.

The present device relieves the machine operator of the milling device in the sense that it assumes his or her control duties with regard to the positioning of the transport vehicle in relation to the milling device. However, for security reasons, this automated process should preferably be able to be manually deactivated at any time by the operator of the milling device. To this end, an actuating device with an actuator which is arranged within the reach of an operator of the milling device is preferably provided, said actuating device being designed in such a way that control commands, in particular for the activation and deactivation of the device for controlling a loading process, can be entered via the actuator and transmitted via the actuating device to the control device. Thus, the operator of the milling device is not absolutely dependent on the functioning of the device for controlling a loading process according to the present invention, but can perform manual inputs, which are given priority over the automatic control commands of the control unit.

The present invention finally also relates to a milling machine, in particular road milling machine or device for the removal of soil material, especially with a transport device preceding in the working direction, with the device according to the present invention for implementing the method according to the present invention.

BRIEF DESCRIPTION OF THE DRAWINGS

The present invention will be explained below in greater detail with reference to the exemplary embodiments shown in the drawings, wherein.

Identical components are indicated below with identical reference numerals.

DETAILED DESCRIPTION OF THE INVENTION

Figure 1A:
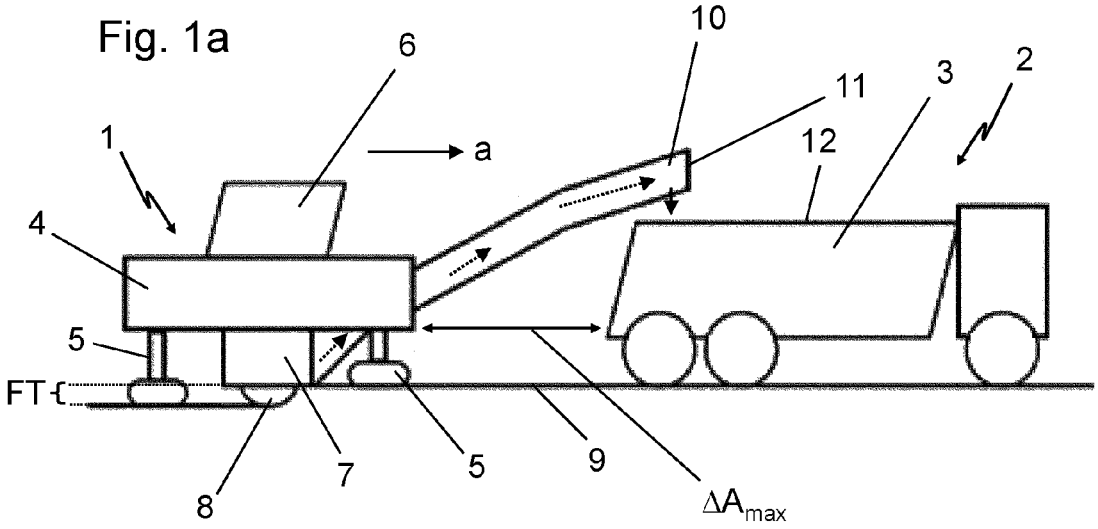
FIGS. 1*a* and 1*b* show a side view and plan view of an exemplary milling device and a transport vehicle.
Figure 1B:
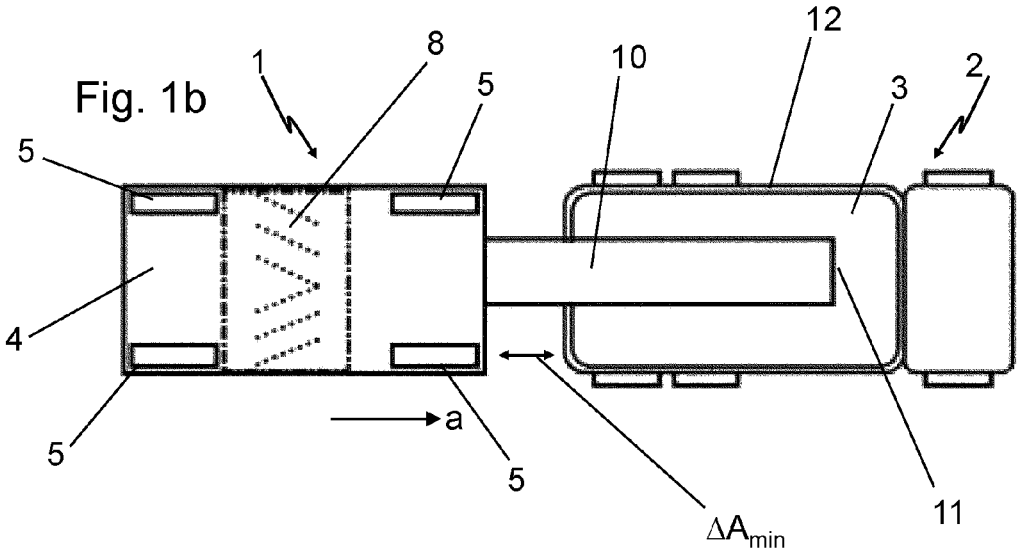

The FIGS. 1*a* and 1*b* illustrate a typical or exemplary work situation of a milling device 1 in side view (FIG. 1*a*) and in plan view (FIG. 1*b*). The milling device 1 mills off the soil material in milling operation to the respectively set milling depth FT and transfers this milled material (milled off soil material) into the transport container 3 of a transport vehicle 2 (actually a semitrailer). The milling device 1 comprises for this purpose a machine frame 4, a chassis 5 (comprising a total of four individual lifting columns with caterpillar gondolas), an operator workstation 6 and a milling rotor 8 mounted in a milling roller case 7, extending transversely to the working direction a of the milling device 1 and moving over the soil 9 to be milled off. The milled material is transported via a conveyor designed as a conveyor belt 10 from the milling device 1 to the transport vehicle 2. In the present embodiment, the conveyor belt 10 runs to the front or in the working direction a, and extends from the front of the machine frame 4 of the milling device obliquely ascending and pointing upwards in the vertical direction. The conveyance of the milled material in the conveying direction is indicated in FIG. 1*a* with the dotted arrows. At the upper end 11 of the conveyor 10, the milled material is ejected and lands in the transport container 3. As soon as the transport container 3 has reached its predetermined fill level, the transport vehicle 2 moves away from the milling device 1, and is, for example, replaced by another transport vehicle 2 with an empty transport container 3 for continuing milling operation. The transport container 3 is thus loaded from the top of the conveyor belt 10 by the ejected milled material. The transport container 3 has a front and a rear wall and corresponding side walls and a bottom and has a substantially box-like appearance. The receiving space of the transport container 3 is delimited at the top by a peripheral upper edge 12.

In practical use, the milling device 1 moves in milling operation at a nearly constant speed, but relatively slow along the working direction a. On the contrary, the transport vehicle 2 does not move at the same speed, but at intervals or in stop-and-go operation, since continuous forward movement at the speed of the milling device would result in strong wear of the transport vehicle 2. In the case of a milling device 1 loading in the working direction a to the front, the transport vehicle initially stands at the distance $\Delta A_{max}$, measured here in the working direction a as the distance between the machine frame 4 and the rear side of the transport container 3, along the working direction a in front of the milling device 1. During milling operation, the milling device 1 moves towards the transport vehicle 2 along the working direction a until the minimum distance$\Delta A_{min}$ (FIG. 1*b*) is reached. In order to prevent a collision of the two vehicles or discharging of the milled material beyond the front edge of the transport container, upon reaching the minimum distance$\Delta A_{min}$ the transport vehicle 2 moves forward and stops upon reaching the initial maximum distance $\Delta A_{max}$ from the milling apparatus 1. In relative terms, the distance between the milling device 1 and the transport vehicle 2 increases and decreases in general several times between$\Delta A_{max}$ and $\Delta A_{min}$ during a loading process. The minimum distance$\Delta A_{min}$ and the maximum distance$\Delta A_{max}$ are dimensioned such that there is no collision between the two vehicles, and at the same time, the milled material is discharged as completely as possible and distributed over the entire length of the transport container 3 into the transport container 3 (above the upper edge 12).

Previously, coordination of this movement of the two vehicles relative to one another required that the operator of the milling device 1 signalled each time to the driver of the transport vehicle 2 when the minimum distance$\Delta A_{min}$ had been reached and the transport vehicle 2 had to be set in motion, when the maximum distance$\Delta A_{max}$ had been reached and the transport vehicle 2 had to be stopped, and finally, to be no longer loaded when the transport container 3 had reached its predetermined fill level, so that the transport vehicle 2 could depart. At the same time the machine operator of the milling device had to observe and control the milling process, so that the machine operator of the milling device 1 was involved with a variety of different tasks and high demands were placed on him/her.

In order to reduce the stress of the milling machine operator 1, a sensor device according to one aspect of the present invention is now provided, with the help of which the operator is relieved considerably of the monitoring and continuous instruction to the transport vehicle 2 during milling operation. The operation and specific arrangement of the sensor device is illustrated in greater detail by the exemplary embodiments shown in the following figures.

Figure 2A:
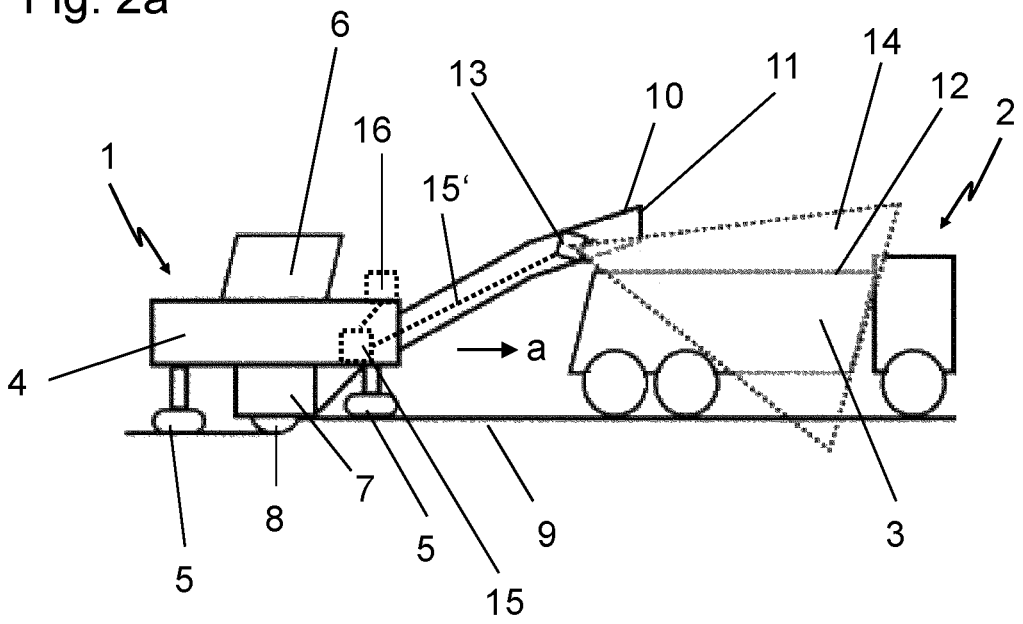
FIGS. 2*a* and 2*b* show a side view and plan view of the milling device of FIGS. 1*a* and 1*b* with the sensor device.
Figure 2B:
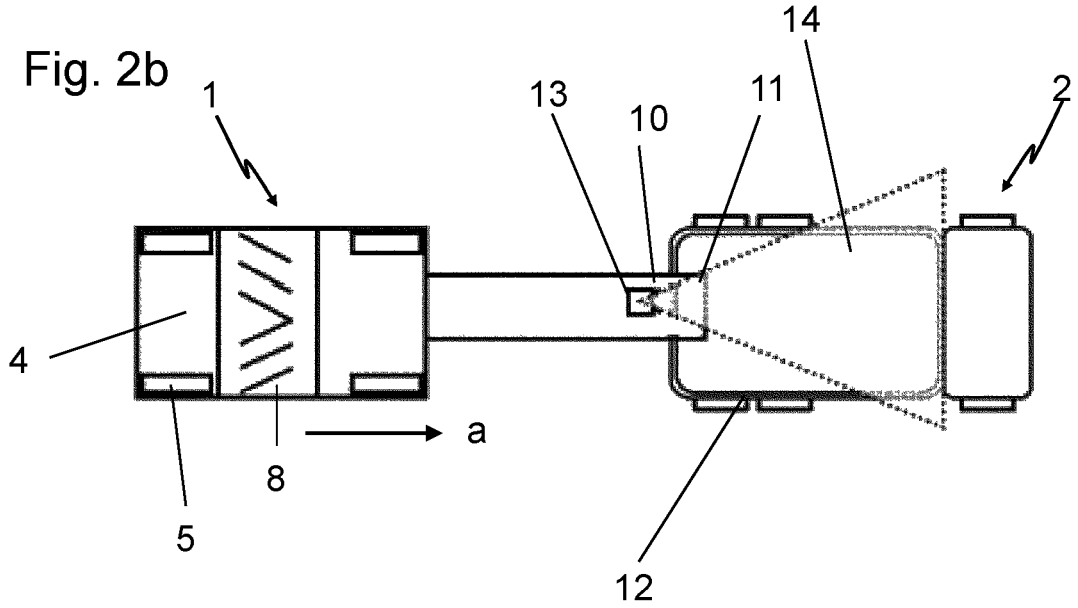

According to the embodiment shown in FIGS. 2*a* and 2*b*, the sensor device comprises a sensor camera 13 for the detection of 3D or spatial information (specifically, a stereo vision camera), which is arranged at the upper end of the conveyor belt 10 facing towards the transport vehicle 3. The sensor camera 13 is arranged so high that it is positioned above the upper edge 12 of the transport container 3. Thus the sensor camera 13 is arranged on the conveyor belt 10 in such a way that its detection range faces towards the filling opening of the transport container 3 (limited by the upper edge 12). The detection range is the area that is captured by the sensor camera 13. The detection cone 14 of the sensor camera 13 is shown in FIGS. 2*a* and 2*b* with the dotted, shaded cone. The sensor camera 13 is in particular able to detect at least partially the upper edge 12 of the transport container 3 or differentiate the same from the environment and thus determine and track its position relative to the milling device 1. Simultaneously, in the present embodiment, the particular arrangement of the sensor camera 13 allows detection in at least a sub-area of the interior of the transport container 3, so that the current fill level with the milled material in the transport container 3 can also be determined. to this end, the detection cone 14 of the sensor camera 13 does not detect the complete top edge 12 of the transport container 3 and also not the complete receiving space of the transport container 3 but, depending on the distance of the milling device 1 from the transport vehicle 2, only a respective sub-area.

The sensor camera 13 is connected to a control unit 15, as exemplary shown in FIG. 2*a* by the dashed connecting line 15'. The control unit 15 receives the data determined by the sensor camera 13 and determines the total fill level of the transport container 3 described in more detail below. Moreover, the control unit 15 in the present embodiment coordinates the positioning of the transport vehicle 2 relative to the milling device 1 and also controls a display device 16 as a function of the relative distance of the transport vehicle 2 to the milling device 1. The operation of the display device 16 is further explained below in FIG. 6.

Figure 3A:
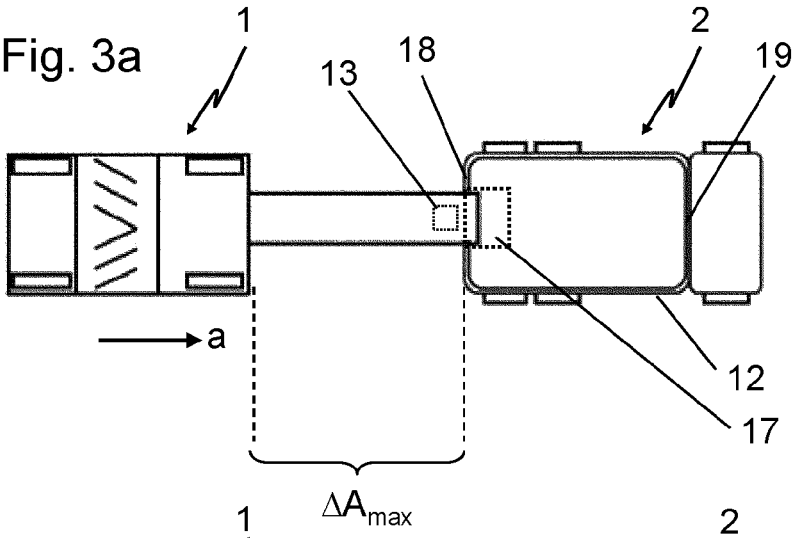
FIGS. 3*a*, 3*b* and 3*c* show plan views of the proceeding loading process.
Figure 3B:
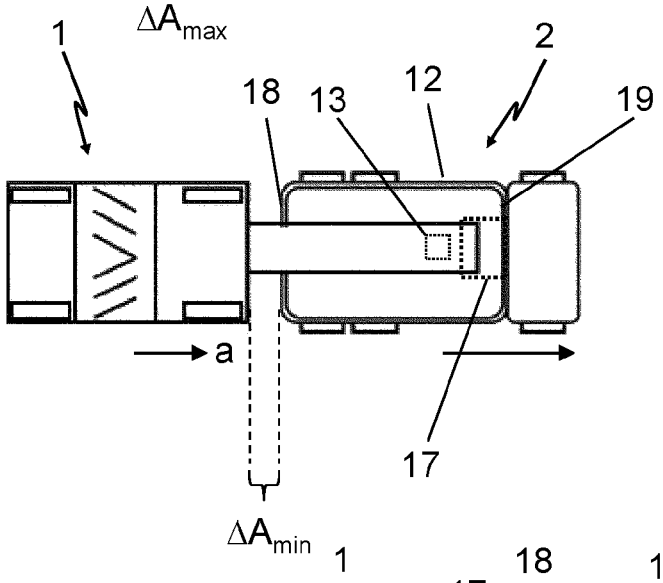
Figure 3C:
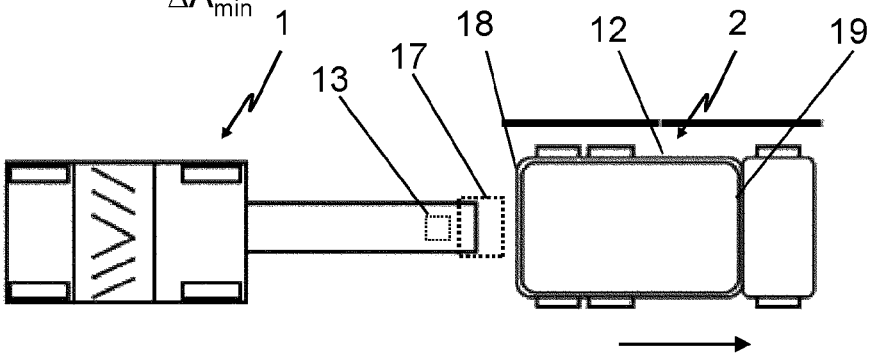

FIGS. 3*a*, 3*b* and 3*c* further illustrate the operation of the present device for controlling the loading process as shown in FIGS. 2*a* and 2*b*, with FIG. 3*a* showing the maximum distance$\Delta A_{max}$ between the milling device 1 and transport vehicle 2 and FIG. 3*b* showing the minimum distance$\Delta A_{min}$ in plan view. FIG. 3*c* finally illustrates the case in which the transport vehicle 2 is no longer or not yet in the loading range 17 of the milling device 1. For reasons of clarity, the control unit 15 is not illustrated in the FIGS. 3*a* to 3*c*.

The loading range 17 is that portion at the height of the upper edge 12 of the transport container 3 within which the milled material falls from the conveyor belt 10 into the transport container 3. The loading range 17, in other words, specifies the area where the milled material coming from the conveyor belt 10 and passing the upper edge 12, enters into the receiving area of the transport container 3 limited at the sides. Only if at least a part of the transport container 3 is in the loading range 17, or the loading region is fully inside the outer edges 12 of the transport container 3 along the horizontal direction, the milled material falls from the conveyor belt 10 completely into the transport container 3. With the change in the relative distance between the milling device 1 and the transport vehicle 2, the loading range 17 also moves relative to the transport vehicle 2, and in particular to the transport container 3. In order to allow complete material transfer of the milled material from the conveyor belt 10 into the transport container 3, the loading range 17 should ideally be in the area of the transport container 3, as otherwise milled material would fall beside the transport container 3.

FIG. 3*a* shows the maximum distance of the milling device 1 loading to the front. The maximum distance is ultimately defined by the upper edge 12 of the rear wall 18 of the transport container 3 and its distance to the machine frame 4 of the milling device 1. If the distance between the milling device 1 and the transport vehicle 2 is further increased, the milled material falls beside the transport container 3 behind the transport vehicle 2. The minimum distance$\Delta A_{min}$ is reached when the milling device 1 is moved so far up to the transport vehicle that the upper edge 12 of the front wall 19 of the transport container adjoins the loading range 17 (so that the milled material completely just still falls into the transport container 3) or the milling device 1 is moved up so close to the transport vehicle 2 that there is just still no collision between the two vehicles. It goes without saying that the position of the loading range in practical use is not necessarily located below the conveyor belt, but, for example, can also be offset to the front in the direction of discharge. During operation of the device with the sensor camera 13, the control unit 15 and the display device 16 as specified in the FIGS. 2*a* and 2*b* (not illustrated separately in the FIGS. 3*a* to 3*c*), it follows that the milling device 1 moves back and forth between the maximum distance $\Delta A_{max}$ and the minimum distance $\Delta A_{min}$, relative to the transport vehicle 2 for complete loading, because the transport vehicle 2 does not move in coordination with the milling device 1 operating uniformly along the working direction a, due to the above-mentioned reasons. The interval-like advancement of the transport vehicle 2, triggered by the attainment of the minimum distance$\Delta A_{min}$, up to the maximum distance $\Delta A_{max}$ is coordinated by a display device 16 controlled by the control unit 15, so that the operator of the milling device 1 does not have to pay attention to an appropriate spacing between the two vehicles in the working mode. FIG. 3*c* finally shows the case in which the transport vehicle 2 is too far away from the milling device 1, or in other words, no transport container 3 is detected by the sensor camera 13 in the loading range 17. In this case, the control unit 15 is configured in such a way that the loading process is not started automatically, but, in this specific embodiment, rather a warning message is issued to the operator. However, the control of the milling device 1 is designed in such a way that the machine operator may start the operation of the conveyor belt 10 without the presence of a transport container 3 in the loading range 17. The loading range 17 can also vary in size and can be adapted to the individual circumstances. What is important is that the loading range 17 ensures loading at a distance from the edge of the transport container 3, preferably centrally along the working direction a, so that the distribution of the milled material at the edge of the transport container 3 is essentially via gravity and flow behaviour. Further details on the interaction between the sensor camera 13, the control unit 15 and the display device 16 are shown below in FIG. 6.

Figure 4:
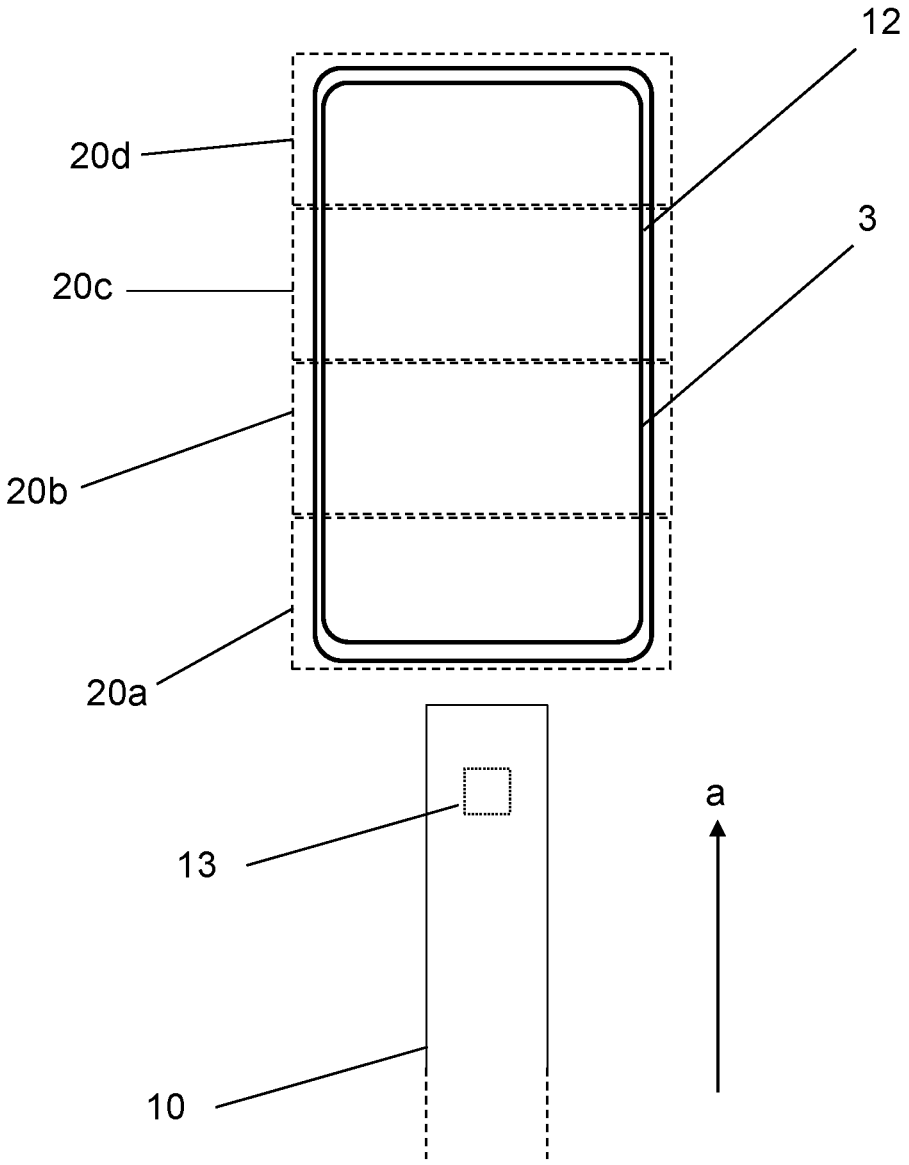
FIG. 4 illustrates the detection of the sub-areas of the transport container by the sensor device.

FIG. 4 illustrates the operation for determination of the total fill level of the transport container 3 for the case that the sensor device, specifically the sensor camera 13, does not detect the entire transport container 3 but only a respective sub-area in each case. To this end, the transport container 3 is virtually divided into four sub-areas 20*a* to 20*d*, wherein, alternatively, for example, markings may also be possible on the top edge 12 of the transport container 3 for defining the portions 20*a* to 20*d* and detection by the sensor camera 13. It goes without saying that the subdivision may also be much finer, and may even be partly overlapping. The sensor camera 13 is designed so as to detect a respective sub-area 20*a*, 20*b*, 20*c* or 20*d* while the milling device 1 approaches the transport vehicle 2 along the working direction a, wherein the individual sub-areas are crossed in the order 20*a*, 20*b*, 20*c*, 20*d* when approaching the transport vehicle 2. If the transport vehicle 2 advances, relative to the milling device, up to the maximum distance$\Delta A_{max}$, the detection of the sub-areas 20*a* to 20*d* occurs accordingly in the reverse order. Upon detection of the sub-area 20*d*, the minimum distance$\Delta A_{min}$ between the milling device 1 and the transport vehicle 2 is attained. Once the sensor camera 13 has detected a sub-area 20*a*, 20*b*, 20*c* or 20*d*, it stores the fill level of the transport container determined for each one of the sub-areas 20*a* to 20*d* in a memory of the control unit 15. If a sub-area is detected several times by the sensor camera 13, the most recent data is stored in the memory. The control unit 15 is now designed in such a manner that it uses a currently determined record for a sub-area (for example, sub-area 20*a*) and the stored fill levels for the remaining sub-areas (in this case, for example, sub-areas 20*b*, 20*c* and 20*d*) and determines the total fill level of the transport container 3 from these values. This makes it possible to monitor the total fill level of the transport container 3 sufficiently even though the corresponding sensor device, specifically the sensor camera 13, detects only a respective sub-area of the transport container 3 for fill level determination.

Figure 5A:
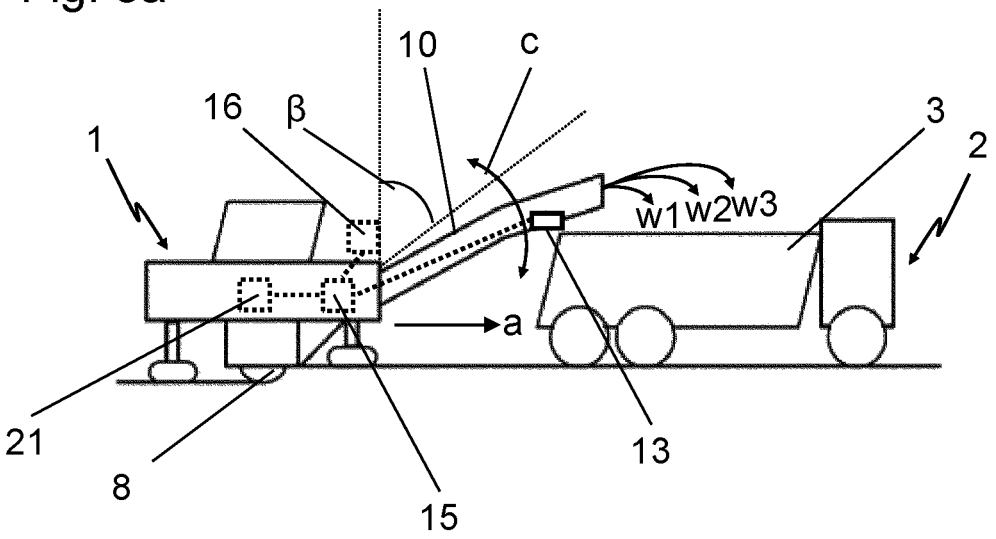
FIGS. 5*a* and 5*b* illustrate control operations by the control unit in a side view and a top view.
Figure 5B:
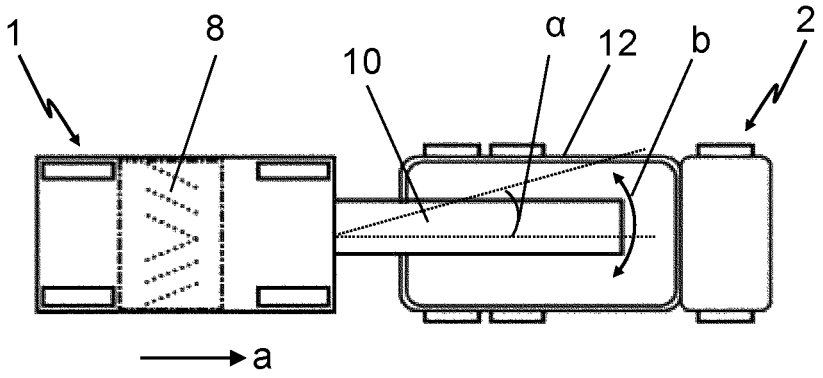

The FIGS. 5*a* and 5*b* involve a more advanced embodiment of the control unit 15. The control unit 15 of the FIGS. 5*a* and 5*b* is not only designed for the evaluation of the data determined by the sensor camera 13, but also for the control of certain machine functions. This is illustrated in FIG. 5*a* by the connection of the control unit 15 with a machine controller 21. The machine controller 21 in the present embodiment is designed essentially to control functions with regard to the orientation and the transport speed of the conveyor belt 10. Thus, it is possible with the machine controller 21, for example, to vary the lateral deflection $\alpha$ (FIG. 5*b*; deflection in the horizontal plane), the vertical deflection $\beta$ (deflection in the vertical plane) and the discharge width w through regulation of the conveying or circumferential speed of the conveyor belt 10, wherein for the respective applications corresponding actuators are provided, which are controlled by the machine controller 21 and which control the adjustment of the respective operating parameters. The angle α as lateral deflection angle results from the adjustment of the longitudinal extension of the conveyor belt along the horizontal plane in relation to the longitudinal extension of the conveyor belt 10 along the working direction a. On the other hand, the angle β, as a measure for the vertical adjustment, specifies the lowering or pitch of the conveyor belt 10 or its longitudinal extension in relation to a vertical perpendicular. Accordingly, for adjustment of the angle α, the conveyor belt 10 is adjusted as indicated by arrow b in FIG. 5*b*; on the other hand, for an adjustment of the angle β, the conveyor belt 10 is adjusted according to the arrow c in FIG. 5*a*. Regulation of the conveying speed of the conveyor belt 10 finally results in displacement of the loading range 17 or a change in the respective discharge width, as indicated in FIG. 5*a* by the discharge widths w1 to w3. The discharge width w1 is obtained at a comparatively low, the further discharge widths w2 and w3 at higher rotational speeds of the conveyor belt 10.

Figure 6:
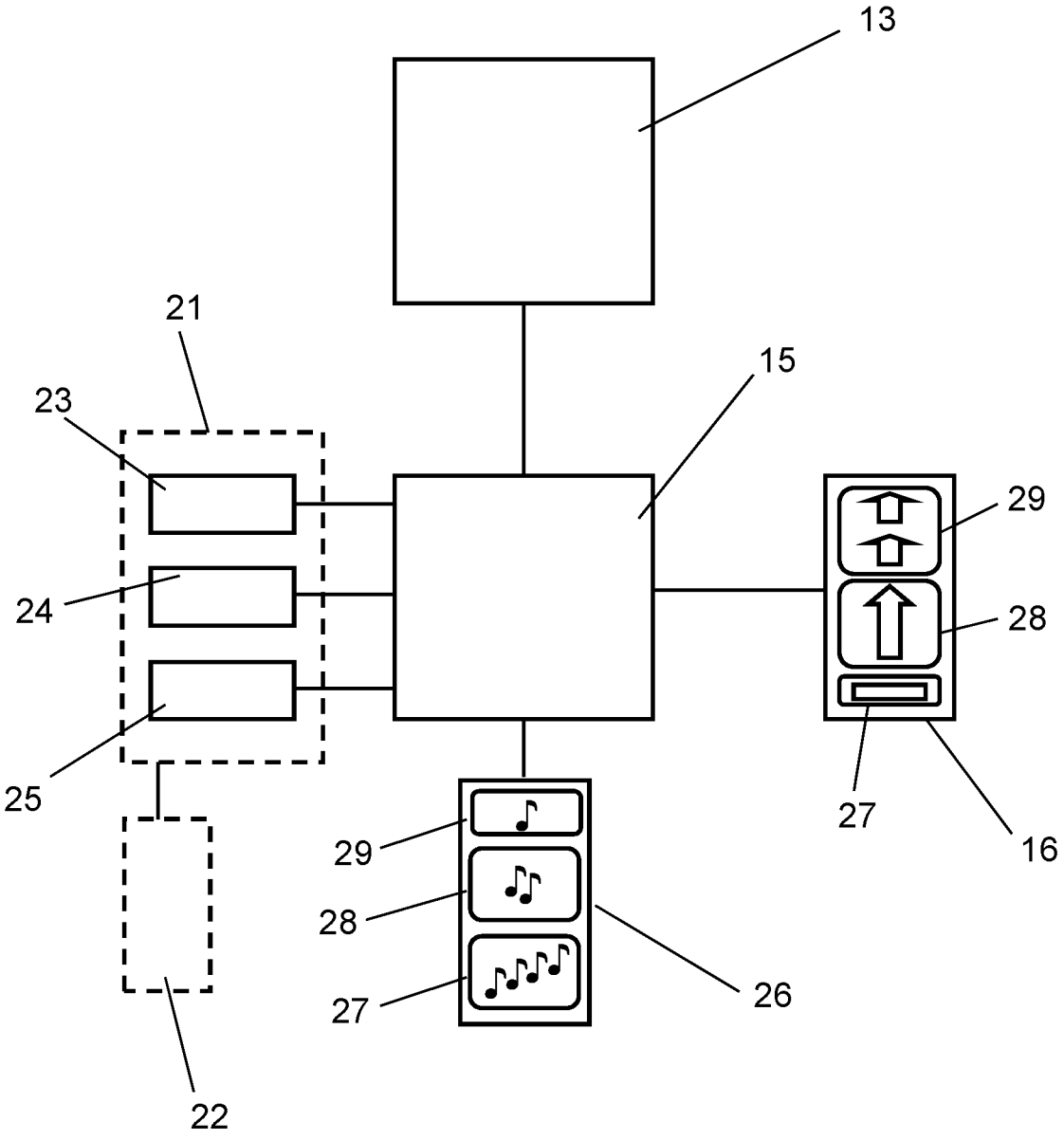
FIG. 6 shows the operation of the control unit.

FIG. 6 further illustrates the integration of the control unit 15 of FIGS. 5*a* and 5*b* into the milling device 1. Initially, the control unit 15 detects the data identified by the sensor camera 13 and monitors the filling status of the transport container 3 on the basis of these data. The control unit 15 is also connected to the machine controller 21. In the process, the control unit 15 receives, on the one hand, information from the machine controller 21, for example, with regard to the current operating state of the milling rotor 8 (in milling operation or deactivated), with regard to the working or travelling speed of the milling device 1, with respect to the conveying speed of the conveyor belt 10, etc. For this purpose, appropriate sensors are connected via the machine controller 21 to the control unit 15, which are indicated in FIG. 6 by the reference numeral 22. On the basis of the data provided by the sensor device 13, the control unit 15 determines whether the loading range 17 lies completely in the transport container 3 and, if so, whether regulation of the position of the conveyor belt, for example, through actuation of the actuators 23 (for the vertical displacement) and 24 (for the horizontal adjustment) and/or regulation of the discharge width w through control of the rotational speed of the conveyor belt (for example, via actuation of the motor control 25 for the drive roller of the conveyor belt) is required.

The control unit 15 also coordinates the visual display device 16 and an acoustic signalling device 26 to issue the commands "drive forward", "stop", "depart" to the driver of the transport vehicle 2, depending on the distance of the transport container 3 from the milling device 1. Both the visual display device 16 and the acoustic display device 26 can be operated independently and are able to display the commands "stop" 27, "drive forward" 28 and "depart" 29 automatically as a function of the results determined by the sensor device 13 regarding location and fill level of the transport container 3 without contribution by the milling machine operator.

Figure 7:
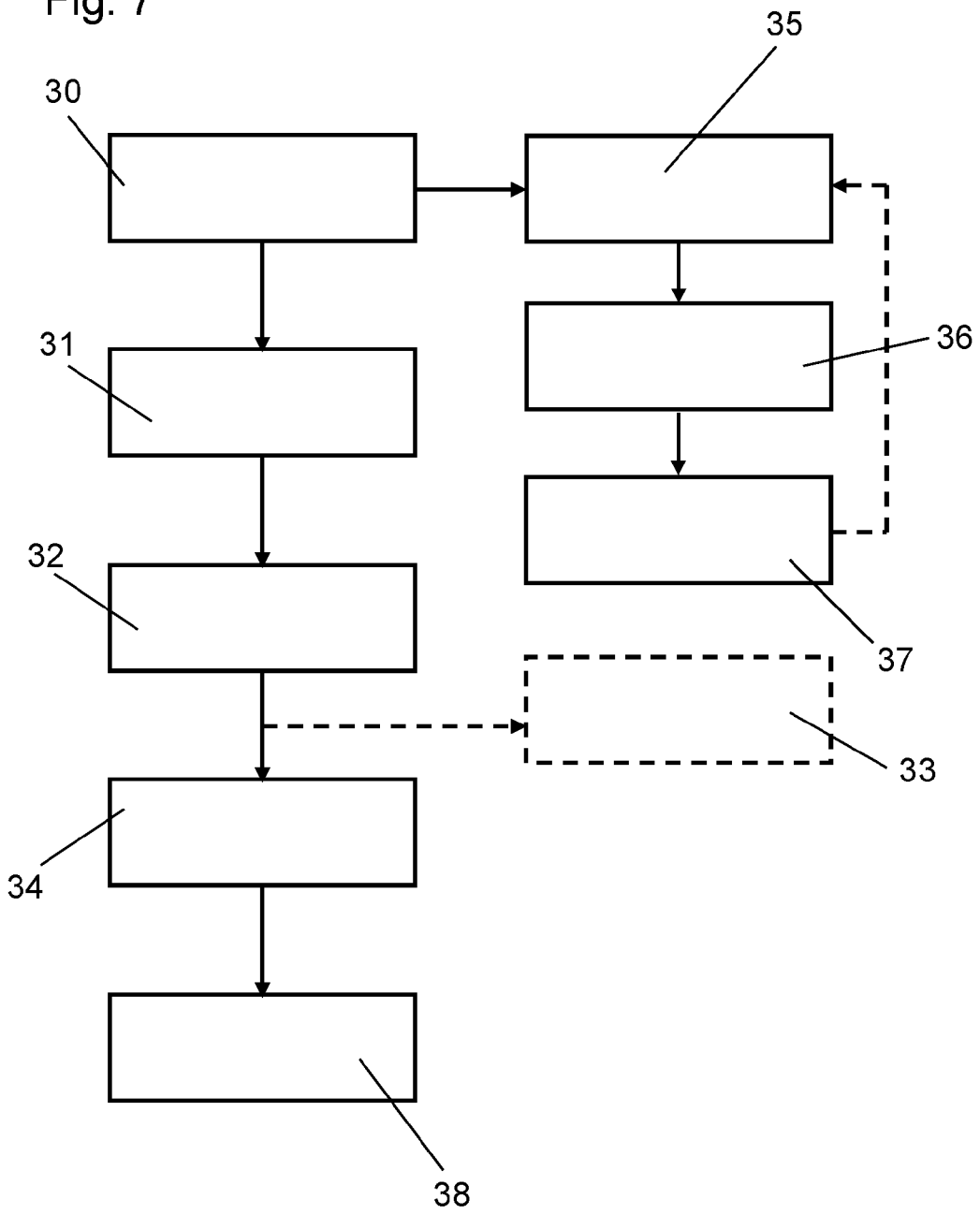
FIG. 7 shows a flow chart for controlling a loading process.

FIG. 7 finally illustrates the essential steps for implementing the method for controlling a loading process of the transport container 3 of the transport vehicle 2 by the milling device 1 in the milling operation.

In step 30, at first the relative position of the transport container 3 in the loading range 17 of the milling device 1 is detected by means of the sensor camera 13 In other words, in this step, the sensor device 13 determines whether the loading range is located within the transport container 3 and milled material would thus be completely conveyed into the transport container 3. As soon as the control unit 15 determines that the loading range 17 is located within the upper edge 12 of the transport container 3, the control unit 15 starts the loading process by actuating the conveyor belt 10 according to step 31 and/or notifies, in an alternative embodiment, the operator of the milling device that the loading process can be started. During the loading process, the control unit 15, using the sensor camera 13 according to step 32, monitors the relative position of the transport container and controls the loading process depending on the relative position of the transport container 3. The control of the loading process can initially be carried out in such a way that the control unit 15 automatically switches off the conveyor belt 10 as soon as the loading range 17 is no longer within the receiving opening,—defined by the upper edge 12, of the transport container 3, or the operator of the milling device gives a corresponding signal. However, in an alternative further preferred embodiment, the control of the loading process according to step 33 also includes regulation of other operating parameters, such as the position of the conveyor in the horizontal plane, and its inclination, as well as the control of the rotational speed of the conveyor belt 10 for regulation of the discharge width of the milled material at the outlet of the conveyor belt 10. As soon as the control unit detects the attainment of the predetermined fill level of the transport container, it preferably signals this information to the machine operator of the milling device 1 and/or, depending on the embodiment, automatically stops the loading process in accordance with step 34.

According to the embodiment shown in FIG. 7, parallel to these process steps, the control unit 15 simultaneously takes over the control of the signalling device 16 and/or 26, wherein at first, following step 30, the attainment of the minimum distance $\Delta A_{min}$ according to step 35 is awaited. The control unit 15 then issues the command "drive forward" 28 via the signalling device 26 and/or 16 in accordance with step 36, until the maximum distance between the milling device 1 and the transport vehicle 2, $\Delta A_{max}$ is reached. At this time, the control unit 15 in step 37 signals "stop" 27, and thus instructs the driver of the transport vehicle 2 to stop. The sequence of steps 35 to 37 can repeated several times, as is indicated in FIG. 7 by the dashed line. When the transport container 3 has reached its predetermined fill level, the control unit 15 issues the "depart" command 29 according to step 38 via the signalling devices 16 and/or 26 in order to signal completion of the filling process to the driver of the transport vehicle 2.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicant's invention.

What is claimed is:

1. A method of controlling a loading process of a transport container of a transport vehicle by a milling device during a milling operation, wherein the milling device comprises a conveyor, via which milled material is transported to the transport container during a milling operation of the milling device, and a control unit, comprising the steps:

a) detecting the relative position of the transport container in a loading range of the milling device via a sensor device;

b) starting the loading process by starting up the conveyor;

c) monitoring the relative position of the transport container via the sensor device and controlling the loading process by detecting a discharge path of the milled material discharged from the conveyor into the transport container and at least one of the following steps: regulating a discharge width of the discharge path by regulating the operating speed of the conveyor, by vertical adjustment of the conveyor or by adjusting the position angle of the conveyor; and d) issuing a signal when a predetermined fill level of the transport container is determined or as soon as the sensor device detects the removal of the transport container from loading range for stopping the loading process.

2. The method according to claim 1, wherein, in step c), the following steps occur:

1) detecting at least one sub-area of the transport container, and determining the fill level in this at least one sub-area of the transport container;

2) storing the fill level detected in step 1 in the at least one sub-area;

3) detecting a further sub-area of the transport container, determining the fill level in said further sub-area, and storing the detected fill level of said further sub-area;

4) determining the total fill level via the data currently determined in step 3) and the latest data stored in step 2);

5) updating the fill levels of already detected sub-areas of the transport container; and 6) determining the degree of filling of the transport container on the basis of the latest fill levels of each of the sub-areas of the transport container.

3. The method according to claim 2, wherein the step of detecting at least one sub-area comprises detecting a sub-area of an upper edge of the transport container.

4. The method according to claim 1, wherein the control unit, depending on the degree of loading of the transport container or the distance between the milling device and the transport vehicle, controls a signaling device, which at least gives a respective signal for the commands "Drive forward," "Stop" and "Depart".

5. The method according to claim 4, wherein the control unit controls the signaling device or the transport vehicle depending on alternating detection of a front and a rear upper edge of the transport container.

6. The method according to claim 1, wherein the control unit controls driving movement of the transport vehicle during the loading operation.

7. The method according to claim 1, wherein the control unit considers at least one of the following operating parameters of the milling device for controlling the loading process:

speed of the milling device during the milling operation;
activation of a milling rotor;
milling depth of a milling rotor;
operating status of the conveyor;
delivery speed of a conveyor belt of the conveyor;
lateral deflection angle of the conveyor belt; or
inclination angle of the conveyor belt.

8. The method according to claim 1, further comprising the step:

regulating a lateral deflection of the discharge path relative to the transport container through lateral displacement of the conveyor.

9. A device for controlling a loading process of a transport container of a transport vehicle by a milling device during a milling operation, wherein the milling device comprises a conveyor via which milled material is transported into the transport container during a milling operation of the milling device, wherein the device comprises:

a sensor device configured to detect a relative position of the transport container to the milling device, and in that the device comprises a control unit configured to control the loading process based on the relative position of the transport container to the milling device detected by the sensor device; and a control unit configured to regulate a discharge width of a discharge path of milled material by regulating the operating speed of the conveyor, by vertical adjustment of the conveyor or by adjusting the position angle of the conveyor.

10. The device for controlling a loading process according to claim 9, wherein the sensor device is designed for detecting at least one sub-area of an upper edge of the transport container.

11. The device for controlling a loading process according to claim 9, wherein the sensor device comprises a camera device which is designed for detection of 3D information.

12. The device for controlling a loading process according to claim 11, wherein the camera device comprises an electro-optical device with a sensor camera, a stereo vision camera or a camera with a sensor PMD sensor.

13. The device for controlling a loading process according to claim 9, wherein the conveyor comprises a conveyor belt and a supporting frame, and that the sensor device is arranged on the support frame.

14. The device according to claim 13, wherein the sensor device is arranged on an upper end of the support frame.

15. The device for controlling a loading process according to claim 9, wherein a signaling device operated by the control unit is present, and which is designed for issuing at least the three control functions "Drive forward", "Stop" and "Depart".

16. The device for controlling a loading process according to claim 15, wherein the signaling device for issuing the at least three control functions comprises an optical or acoustic output element.

17. The device for controlling a loading process according to claim 9, wherein the control unit comprises a memory element in the form of a rolling memory, wherein the memory element is configured for storing the data determined by the sensor device and stores the most recent record with regard to the respective sub-area of the transport container.

18. The device for controlling a loading process according to claim 9, wherein an actuating device is provided with an actuator which is arranged within the reach of an operator of the milling device, wherein the actuator is designed in such a way that control commands can be entered via the actuator and are transferable via the actuating device to the control unit.

19. A milling machine, comprising a device according to claim 9.

20. The milling machine according to claim 19, wherein the milling machine comprises a road milling machine or a device for removal of soil material.

21. A method of controlling a loading process of a transport container of a transport vehicle by a milling device during a milling operation, wherein the milling device comprises a conveyor, via which milled material is transported to the transport container during a milling operation of the milling device, and a control unit, comprising the steps:

a) detecting the relative position of the transport container in a loading range of the milling device via a sensor device;

b) starting the loading process by starting up the conveyor;

c) monitoring the relative position of the transport container via the sensor device;

d) automatically controlling the loading process via the control unit;

e) regulating a discharge width of a discharge path of the milled material by regulating the operating speed of the conveyor, by vertical adjustment of the conveyor or by adjusting the position angle of the conveyor; and f) issuing a signal to control the loading process when a predetermined fill level of the transport container is determined or as soon as the sensor device detects the removal of the transport container from loading range for stopping the loading process.

* * * * *